US011103082B2

(12) United States Patent
Sadiq et al.

(10) Patent No.: US 11,103,082 B2
(45) Date of Patent: Aug. 31, 2021

(54) MATTRESS ASSEMBLIES INCLUDING A HYBRID POSTURE SUPPORT SYSTEM

(71) Applicant: Dreamwell, Ltd., Atlanta, GA (US)

(72) Inventors: Raheel Sadiq, Smyrna, GA (US); Richard F. Gladney, Fairburn, GA (US)

(73) Assignee: DREAMWELL, LTD., Doraville, GA (US)

( * ) Notice: Subject to any disclaimer, the term of this patent is extended or adjusted under 35 U.S.C. 154(b) by 240 days.

(21) Appl. No.: 15/972,281

(22) Filed: May 7, 2018

(65) Prior Publication Data

US 2019/0335914 A1 Nov. 7, 2019

(51) Int. Cl.

| | |
|---|---|
| ***A47C 23/34*** | (2006.01) |
| ***A47C 27/05*** | (2006.01) |
| ***A47C 23/043*** | (2006.01) |
| ***A47C 27/15*** | (2006.01) |

(52) U.S. Cl.

CPC ..... *A47C 23/34* (2013.01); *A47C 27/056* (2013.01); *A47C 23/043* (2013.01); *A47C 27/15* (2013.01)

(58) Field of Classification Search

CPC ..... A47C 23/34; A47C 23/043; A47C 27/056; A47C 27/15; A47C 27/06; A47C 27/064; A47C 27/148; A47C 27/05; A47C 27/062

See application file for complete search history.

(56) References Cited

U.S. PATENT DOCUMENTS

| | | | | |
|---|---|---|---|---|
| 685,160 | A | 10/1901 | Marshall | |
| 3,462,779 | A * | 8/1969 | Thompson | A47C 27/063 5/655.8 |
| 4,234,983 | A | 11/1980 | Stumpf | |
| 4,234,984 | A | 11/1980 | Stumpf | |
| 4,439,977 | A | 4/1984 | Stumpf | |
| 4,451,946 | A | 6/1984 | Stumpf | |
| 4,523,344 | A | 6/1985 | Stumpf | |
| 4,578,834 | A | 4/1986 | Stumpf | |
| 5,016,305 | A | 5/1991 | Suenens et al. | |
| 5,621,935 | A | 4/1997 | St. Clair | |
| 6,658,682 | B1 * | 12/2003 | Wells | A47C 27/062 5/655.7 |
| 7,047,581 | B2 | 5/2006 | Gladney | |
| 7,168,117 | B2 | 1/2007 | Gladney et al. | |
| 8,099,811 | B2 | 1/2012 | Gladney et al. | |
| 9,295,599 | B2 * | 3/2016 | Dyevich | A61G 7/05715 |
| 9,386,862 | B1 * | 7/2016 | Limer | A47C 27/15 |
| 2010/0072676 | A1 | 3/2010 | Gladney et al. | |
| 2011/0173757 | A1 * | 7/2011 | Rensink | A47C 27/04 5/698 |

(Continued)

*Primary Examiner* — Nicholas F Polito
*Assistant Examiner* — Alison N Labarge
(74) *Attorney, Agent, or Firm* — Cantor Colburn LLP

(57) ABSTRACT

Mattress assemblies include a hybrid posture support system that provide an end user with improved posture support during use, among other advantages. The hybrid posture support system includes a top foam layer including first and second foam portions that are spaced apart and generally correspond to a head/shoulder region and a foot region, respectively, a pocketed microcoil array underlying the top foam layer that is intermediate the first and second foam portions; and an underlying foam layer. The hybrid posture support system can be used in any mattress assembly including mattresses having a coil spring innercore or a foam innercore.

20 Claims, 4 Drawing Sheets

(56) References Cited

U.S. PATENT DOCUMENTS

| | | | | |
|---|---|---|---|---|
| 2012/0102658 | A1* | 5/2012 | Mantzis | A47C 27/062 5/720 |
| 2013/0276239 | A1* | 10/2013 | Roma | F16F 3/04 5/717 |
| 2014/0165292 | A1* | 6/2014 | Gladney | A47C 27/064 5/717 |
| 2014/0289968 | A1* | 10/2014 | Van der Velde | A47C 27/005 5/716 |
| 2015/0296994 | A1 | 10/2015 | Mikkelsen et al. | |
| 2016/0235204 | A1* | 8/2016 | Andreotti | A47C 27/16 |
| 2017/0156508 | A1* | 6/2017 | Segal | A47C 27/001 |
| 2018/0199727 | A1* | 7/2018 | Krtek | A47C 27/064 |

* cited by examiner

MATTRESS ASSEMBLIES INCLUDING A HYBRID POSTURE SUPPORT SYSTEM

BACKGROUND

The present disclosure generally relates to mattress assemblies, and more particularly, to mattress assemblies including a hybrid posture support system for mattress assemblies.

Mattresses such as those formed of polyurethane foam, latex foam, and the like, with or without coiled springs, are generally known in the art. One of the ongoing problems associated with mattress assemblies is user comfort. To address user comfort, these mattresses are often fabricated with multiple foam layers having varying properties such as density and hardness, among others, to suit the needs of the intended user. More recently, manufacturers have employed so called memory foams, also commonly referred to as viscoelastic foams, which are typically a combination of polyurethane and one or more additives that increase foam density and viscosity, thereby increasing its viscoelasticity. These foams are often open cell foam structures having both closed and open cells but in some instances may be reticulated foam structures. When used in a mattress, the memory foam conforms to the shape of a user when the user exerts pressure onto the foam, thereby minimizing pressure points from the user's body. The memory foam then returns to its original shape when the user and associated pressure are removed.

BRIEF SUMMARY

Disclosed herein are hybrid posture support and mattress assemblies including the hybrid posture support systems exhibiting improved posture support during use. In one or more embodiments, a hybrid posture support system for a mattress assembly includes a top foam layer including top and bottom planar surfaces; first and second foam portions underlying the top foam layer having a width that spans a width of the top foam layer and a length that is a fraction of a length of the top foam layer, wherein the first and second foam portions are spaced part from one another and generally correspond to a head/shoulder region and a foot region; a pocketed microcoil array underlying the top foam layer intermediate and abutting the spaced apart first and second foam portions, wherein the microcoil array comprises a plurality of microcoils arranged in columns and rows encased in a fabric and have an unloaded height of less than 3 inches; and an underlying foam layer top and bottom planar surfaces.

In one or more embodiments, a mattress assembly includes a mattress innercore comprising at least one coiled spring layer, and an underlying foam support layer, the at least one coiled spring layer have a height within a range of at least 4 inches to about 12 inches; a hybrid posture support system located along a length of the mattress assembly, the hybrid posture support system including a top foam layer including top and bottom planar surfaces, first and second foam portions having a width that spans a width of the top foam layer and a length that is a fraction of a length of the top foam layer, wherein the first and second foam portions are spaced apart from one another and generally correspond to a head/shoulder region and a foot region; a pocketed microcoil array underlying the top foam layer intermediate the spaced apart first and second foam portions, wherein the pocketed microcoil array comprises a plurality of microcoils arranged in columns and rows encased in a fabric and have an unloaded height of less than 3 inches; and an underlying foam layer; and one or more overlying foam layers.

In accordance with one or more embodiments, a mattress assembly includes a mattress foam innercore; a hybrid posture support system located along a length of the mattress assembly, the hybrid posture support system including a top foam layer including top and bottom planar surfaces, first and second foam portions having a width that spans a width of the top foam layer and a length that is a fraction of a length of the top foam layer, wherein the first and second foam portions are spaced apart from one another and generally correspond to a head/shoulder region and a foot region; a pocketed microcoil array underlying the top foam layer including and intermediate the spaced apart first and second foam portions, wherein the pocketed microcoil array comprises a plurality of microcoils arranged in columns and rows encased in a fabric and have an unloaded height of less than 3 inches; and an underlying foam layer; and one or more overlying foam layers.

In accordance with one or more embodiments, the hybrid posture support system for a mattress assembly includes a top foam layer including top and bottom planar surfaces; first and second pocketed microcoil array portions underlying the top foam layer having a width that spans a width of the top foam layer and a length that is a fraction of a length of the top foam layer, wherein the first and second pocketed microcoil array portions are spaced part from one another and generally correspond to a head/shoulder region and a foot region; a foam portion underlying the top foam layer intermediate and abutting the spaced apart first and second microcoil array portions; and an underlying foam layer top and bottom planar surfaces.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Disclosed herein are mattress assemblies including a hybrid posture support system that provide an end user with improved posture support during use, among other advantages. The mattress assemblies generally include the hybrid posture support system overlying an innercore, wherein the hybrid posture support system includes a non-latex foam top layer including first and second foam portions embedded therein or adhesively attached thereto that are spaced apart and generally correspond to a head/shoulder region and a foot region, respectively, a pocketed microcoil array underlying the latex foam top layer that is intermediate the first and second foam portions, and an underlying foam layer. The hybrid posture support system can be used in any mattress assembly including mattresses having a coil spring innercore or a foam innercore.

The mattress assemblies may be a mattress of any size, including standard sizes such as a twin, queen, oversized queen, king, or California king sized mattress, as well as custom or non-standard sizes constructed to accommodate a particular user or a particular room. The mattress assemblies are generally rectangularly shaped and configured as one sided mattresses. Advantageously, mattress assemblies including the hybrid posture support system as generally described above provides an occupant thereon with proper spinal alignment and also provides pressure relief. Moreover, the presence of the pocketed microcoil array when used in combination with a coil spring innercore provides increased air flow.

Figure 1:
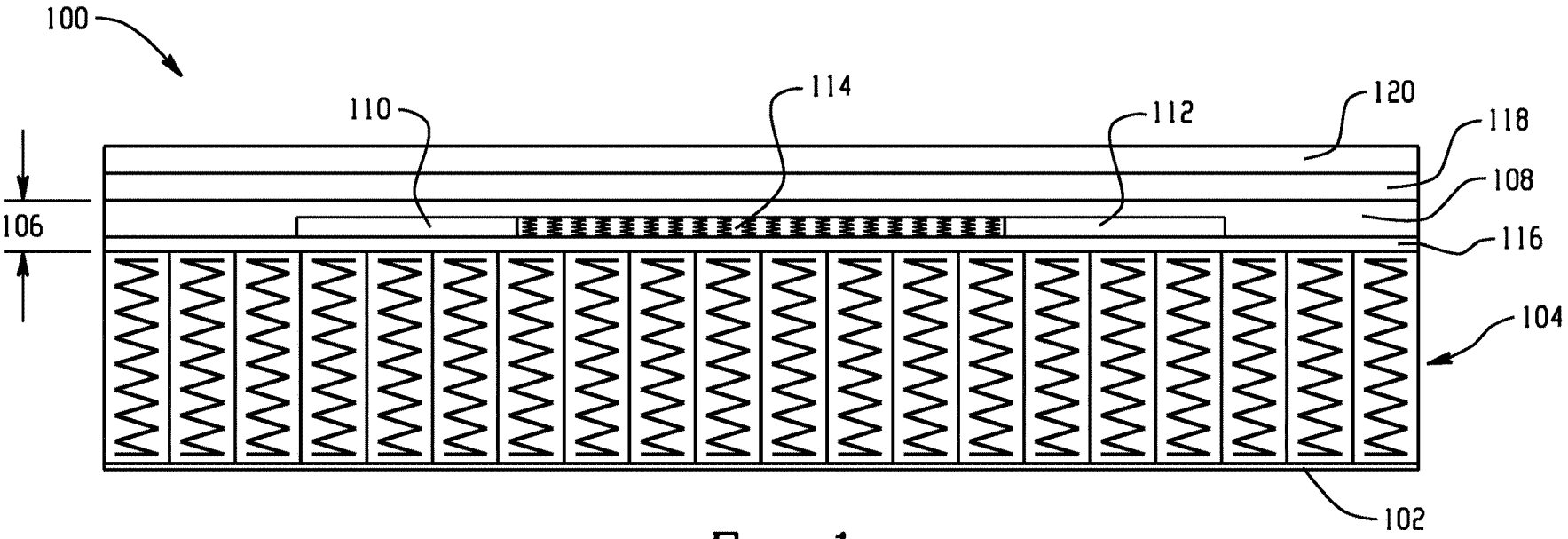
FIG. 1 illustrates a cross sectional side view of a mattress assembly in accordance with one or more embodiments of the present disclosure.
Figure 2:
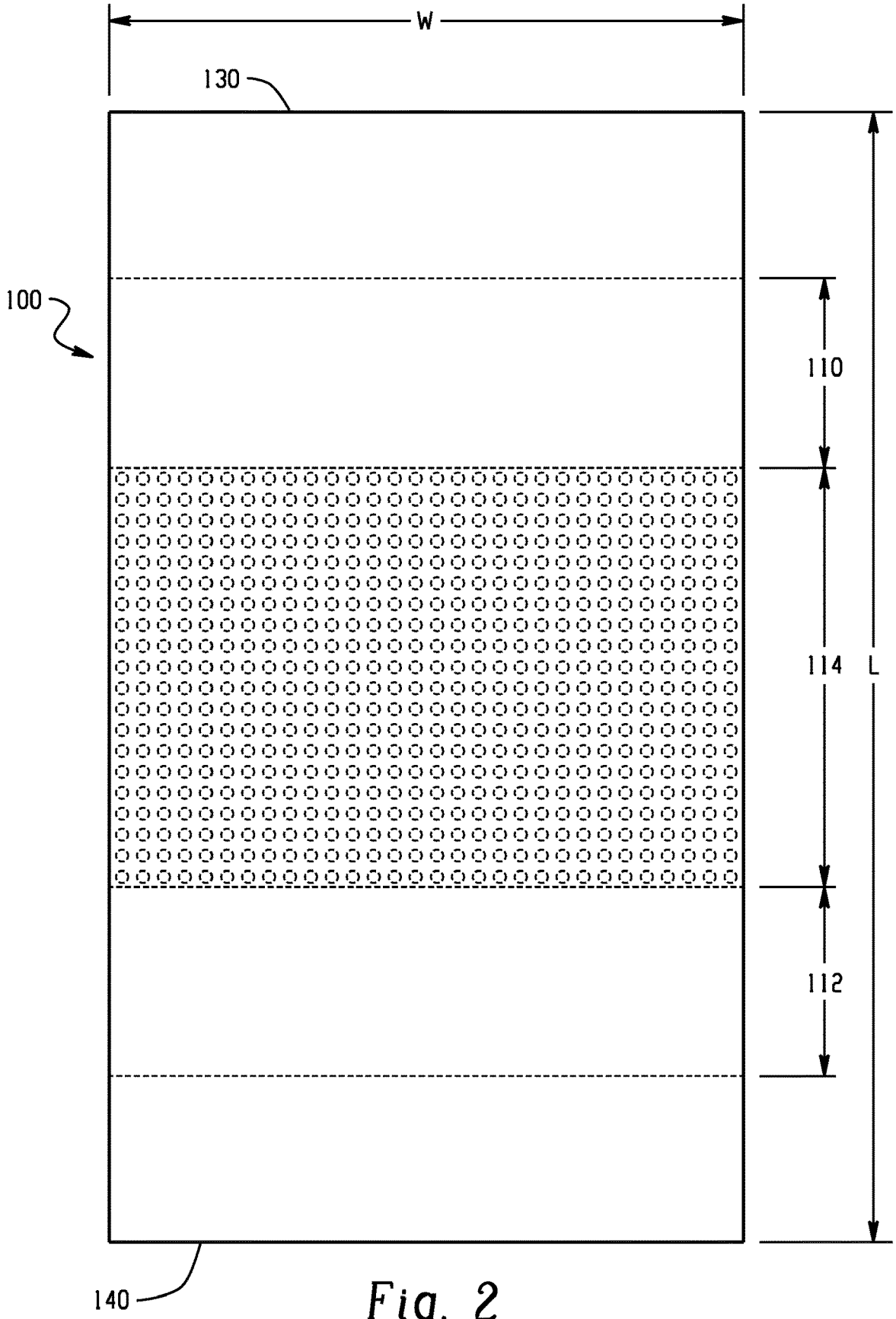
FIG. 2 illustrates a top down view of the mattress assembly of FIG. 1 in accordance with one or more embodiments of the present disclosure.
Figure 3:
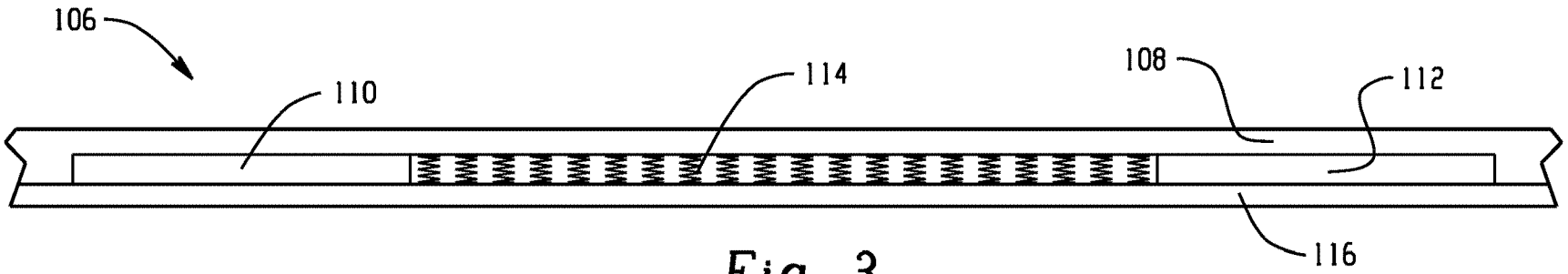
FIG. 3 illustrates a cross sectional view of a hybrid posture support system in accordance with one or more embodiments of the present disclosure.

Turning now to FIGS. 1-3, there is depicted a mattress assembly 100 including a plurality of layers. The mattress assembly 100 has a coil spring innercore 104 of a standard coil height within a range of about 4 to about 10 inches disposed on a foam layer 102. A hybrid posture support system 106 overlies the coil spring innercore 104, wherein the hybrid support system 106 includes a foam top layer 108 including first and second foam portions 110, 112, respectively, embedded therein or attached thereto that are spaced part and generally correspond to a head/shoulder region and a foot region of the mattress assembly, a pocketed microcoil array 114 underlying the foam top layer 108 intermediate the first and second foam portions 110, 112, and an underlying foam layer 116 overlaying the innercore 104. In one or more embodiments, the vertical position of the hybrid posture support system 106 is not intended to be limited so long as it overlays the coil spring innercore 104. In one or more embodiments, the hybrid support system 106 can be in direct contact with the coil spring innercore 104. The illustrated mattress assembly 100 can further include one or more optional foam layers overlying and/or underlying the hybrid posture support system 106, two of which are shown overlaying the hybrid posture support system 106 as indicated by reference numerals 118 and 120.

As shown in the top down view of FIG. 2, the microcoil array 114 as well as the first and second foam portions 110, 112, respectively, spans the width (W) and a portion of the length (L) of the mattress assembly 100, wherein the microcoil array 114 is centrally located along the length (L). Likewise, the first and second foam portions 110, 112 span the width (W) and a portion of the length (L) of the mattress assembly 100. As shown more clearly in FIG. 3, the pocketed microcoil array 114 is intermediate to the first and second foam portions 110, 112 and abuts the first and second foam portions. The first foam 110 is proximate to the head end 130 of the mattress assembly and the second latex foam portion 112 is proximate to the foot end 140 of the mattress assembly 100.

In one or more embodiments, the pocketed microcoil array 114 can have a length from about 6 inches to about 60 inches. In one or more other embodiments, the microcoil array 114 can have a length of about 12 to about 36, and in still one or more other embodiments, the microcoil array 114 can have a length of about 18 to about 28 inches, which is positioned to generally correspond to the lumbar portion of a mattress.

The first and second foam portions 110, 112, can have the same lengths or different lengths. In one or more embodiments, the first and second foam portions 110, 112, can have lengths of about 4 inches to about 24 inches. In one or more other embodiments, the first and second foam portions 110, 112, can have lengths of about 6 inches to about 18 inches, and in still one or more embodiments, the first and second foam portions 110, 112, can have lengths of about 8 inches to about 12 inches. The thickness of the first and second portions 110, 112, respectively, can be within a range about 0.3 inches to about 3 inches. As noted above, the first and second foam portions generally correspond to the head/shoulder region and the foot/leg region and abut each end of the pocketed microcoil array 114.

The first and second foam portions are not intended to be limited to any particular foam. However, generally, the first and second foam portions have different properties and/or are formed of different materials than top foam layer 108 and underlying foam layer 116. By way of example, the first and second foam portions can be a synthetic or natural latex foam, a viscoelastic foam, a gel infused foam, or the like.

By way of example, for a typical standard queen-sized or king-sized mattress, the length dimension is about 80 inches. The microcoil array 114 and the adjacent first and second portions 110, 112, respectively are centrally located along a length of the non-latex foam layer and spans the width dimension from one side of the mattress assembly to the other side of the mattress assembly. The length of the microcoils array 114 can be about 24 inches and the lengths of the first and second foam portions can be about 10 inches. Underlying foam layer 116 and the top foam layer 108 sandwich the pocketed microcoil array 114 and the first and second foam portions 110, 112 to complete the hybrid posture support system 106.

The top foam layer 108 and the underlying foam layer 116 can have the same or different thicknesses. In one or more embodiments, the thickness of these layers 108, 116 is in a range from about 0.5 inches to about 3 inches. Moreover, the top foam layer 108, the underlying foam layer 116 and the optional upper layers that overlay or underlie the hybrid posture support system 106 are not intended to be limited to any particular foam. Suitable other foam layers include, without limitation, polyurethane, viscoelastic polyurethane, polyethylene, polypropylene, a gel infused foam, and the like. Additionally, one of more of the foam layers can be perforated or have convoluted surfaces, can include phase change materials, thermally conductive materials, or the like. Moreover, with respect to the underlying foam layer 116 and optional layers overlying and underlying the hybrid posture support system 106, synthetic and natural latex can be used. Optionally, in some embodiments, one or more of the foam layers including the foam portions 110, 112 may be pre-stressed such as is disclosed in US Pat. Pub. No. 2010/0072676, incorporated herein by reference in its entirety.

The various foams suitable for use in the foam layer may be produced according to methods known to persons ordinarily skilled in the art. For example, polyurethane foams are typically prepared by reacting a polyol with a polyisocyanate in the presence of a catalyst, a blowing agent, one or more foam stabilizers or surfactants and other foaming aids. The gas generated during polymerization causes foaming of the reaction mixture to form a cellular or foam structure. Latex foams are typically manufactured by the well-known Dunlap or Talalay processes.

The different properties of the foam layers 108, 116, the first and second foam portions 110, 112 of the hybrid posture support system 106, as well as the optional foam layers overlying and/or underlying the hybrid posture support system 106, e.g., layers 102, 118, 120, may include, but are not limited to, density, hardness, thickness, support factor, flex fatigue, air flow, various combinations thereof, and the like. Density is a measurement of the mass per unit volume and is commonly expressed in pounds per cubic foot. The hardness properties of foam are also referred to as the indention load deflection (ILD) or indention force deflection (II-D) and is measured in accordance with ASTM D-3574. Like the density property, the hardness properties can be varied in a similar manner. Moreover, combinations of properties may be varied for each individual layer. The individual layers can also be of the same thickness or may have different thicknesses as may be desired to provide different tactile responses.

The hardness for the different foam layers generally have an indention load deflection (ILD) of 7 to 30 pounds force for viscoelastic foams and an ILD of 7 to 45 pounds force for non-viscoelastic foams. The density of the different foam layers 108, 116, and the first and second foam portions 110, 112 can generally range from about 1 to 2.5 pounds per cubic foot for non-viscoelastic foams and 1.5 to 6 pounds per cubic foot for viscoelastic foams. In one or more embodiments, the first and second foam portions 110, 112, respectively, have a hardness and a density greater than the top layer 108 and the underlying layer 116.

The microcoil array 114 includes a plurality of coils contained in separate pockets formed of a piece of fabric disposed between or surrounds each microcoil in the microcoil cell, i.e., pocketed coils. As used herein, a microcoil is a spring or coil that has a smaller height and diameter than conventional innersprings used in mattresses such as that used in a coil innercore. Suitable dimensions for each microcoil include, but are not limited to, a diameter and height of less than about 4 inches. In one or more embodiments, the diameter of less than about 3 inches and in still one or more other embodiments, a diameter of less than about 2 inches. In one or more embodiments, the height of less than about 3 inches and in still one or more other embodiments, a height of less than about 2 inches. The microcoils can be pre-compressed or uncompressed within the pocket. In addition, the microcoil is generally constructed from a thinner or more flexible gauge of wire. In one or more embodiments, the gauge of the wire is greater than about 14 gauge. In another embodiment, the gauge of the wire is at least about 19 gauge. While illustrated as a cylindrical shaped coil with a generally circular cross section, each microcoil can have other shapes including barrel shaped, hour glass shaped or cone shaped and can have other cross-sectional shapes including oblong and rectangular.

As shown, the microcoil array 114 is in the form of a grid including rows and columns of pocketed microcoils. The microcoil array 114 as well as the first and second foam portions 110, 112 can be adhesively secured to a selected one or both of the top foam layer 108 and the underlying foam layer 116.

In contrast to the microcoils, the coils in the innercore coil spring layer 104 can have a coil gauge is about 12 to about 16 and the density of coils within a mattress generally ranges from about 400 to about 2,000. The standard size generally ranges from about 4 inches to about 12 inches. Typically, the standard height is about 8 inches. For many years, one form of spring assembly construction has been known as Marshall Construction. In Marshall Construction, individual wire coils are each encapsulated in fabric pockets and attached together in strings which are arranged to form a closely packed array of coils in the general size of the mattress. Examples of such construction are disclosed in U.S. Pat. Nos. 685,160, 4,234,983, 4,234,984, 4,439,977, 4,451,946, 4,523,344, 4,578,834, 5,016,305 and 5,621,935, the disclosures of which are incorporated herein by reference in their entireties.

The coil springs are not intended to be limited to any specific type or shape. The coil springs can be single stranded or multi-stranded, pocketed or not pocketed, asymmetric or symmetric, and the like. It will be appreciated that the pocket coils may be manufactured in single pocket coils or strings of pocket coils, either of which may be suitably employed with the mattresses described herein. The attachment between coil springs may be any suitable attachment. For example, pocket coils are commonly attached to one another using hot-melt adhesive applied to abutting surfaces during construction.

The proposed coil spring construction for use in the mattress assembly can employ a stranded wire spring which is made of at least 2 wire strands that are twisted to form a multi-wire cord. The number of strands employed will vary according to the application and may vary based on the type of material used to form the strand. Thus, the wire may include two or more strands, and can include from three to fifty strands.

The strands may be twisted, weaved, clipped or bonded together and any suitable method for forming the stranded wire spring may be employed without departing from the scope of the invention. The strands may be steel, aluminum, plastic, copper, titanium, rubber or any other suitable material and the type of material selected will depend upon the application at hand. Moreover, the strands may have any suitable shape and may be long cylindrical wires, hexagonal wire, square wire or any other shape or geometry. Additionally, the wire strand gauge may vary according to the application and in one embodiment comprises 710 gauge wire, although other gauges may be used.

In one practice, coiling may be achieved construction by passing a braided strand through a coiler, such as the type of coiler employed for forming steel mattress coils wherein a heavy-gauge steel wire is compressed into a barrel-shaped coil such that no turns touch for eliminating noise and vibration. The coils may then be passed to a pocketing machine or station to pocket the springs into individual sleeves of a non-woven, non-allergenic fabric such as Duon. Each sleeve may be ultrasonically sealed, a process where the fibers are melted together to form solid plastic seams that are secure and tear-resistant. The coils are then fusion bonded to produce a strong, stable construction. The number of coils in each unit may vary, and the types of coils and the number of strands and gauge of strands can vary from pocket to pocket.

The individual strands are connected with each other at least at the ends of the coil. Since the strands can rub against each other over the length of the coil, which can cause fretting and premature wear, the strands may be coated and/or pre-galvanized. Moreover, the stranded coil may also be sealed with a sealant, such as an epoxy. Thus, in alternative and optional embodiments, the strands may be coated or otherwise treated and the wire may be sealed or coated. Exemplary stranded wire for use in mattresses is disclosed in U.S. Pat. Nos. 7,047,581, 7,168,117, and 8,099,811 incorporated herein by reference in its entireties.

Figure 4:
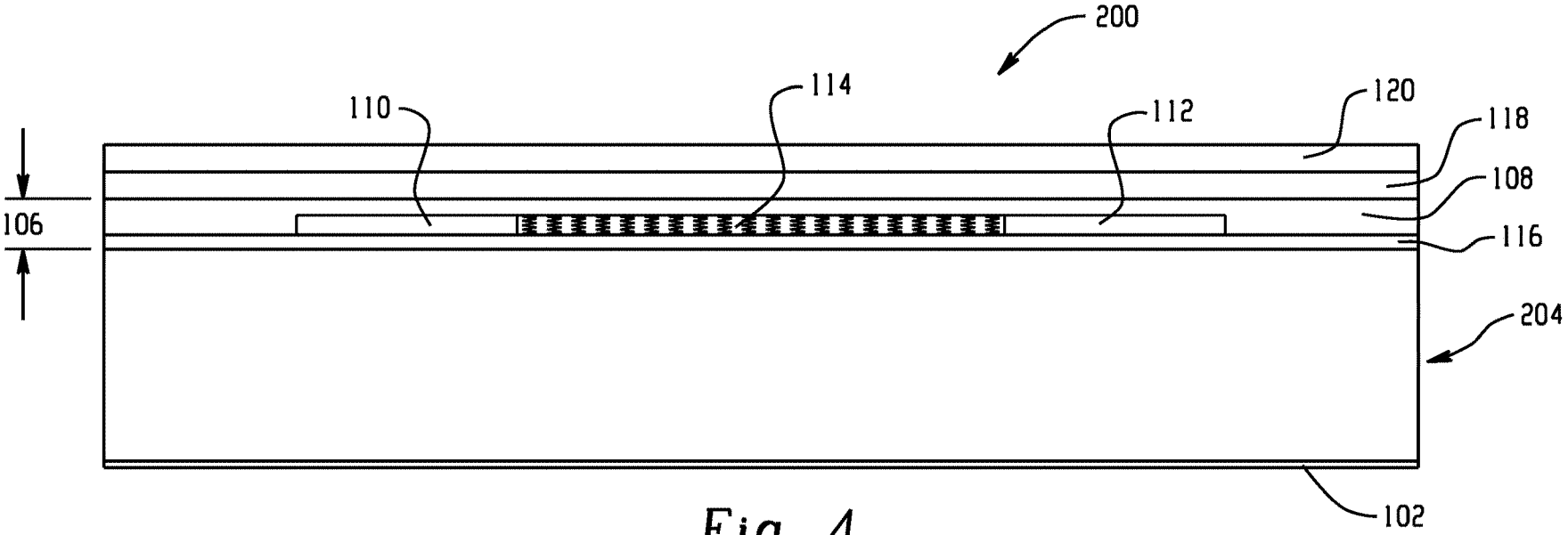
FIG. 4 illustrates a cross sectional side view of a mattress assembly in accordance with one or more embodiments of the present disclosure.

Referring now to FIG. 4, there is depicted a mattress assembly 200 including the hybrid posture support system 106 as discussed above overlying a foam innercore 204. The mattress assembly 200 can include optional foam layers, e.g., 118, 120 overlaying the hybrid posture support system 106, foam layers, e.g., 102, underlying the foam innercore 2014, and foam layers (not shown) intermediate the hybrid support system 106 and the innercore 204.

The foam, in some embodiments, can be a monolithic block of a single type of resilient foam selected from foams having a range of densities (themselves well-known in the art) or multiple foam layers for supporting one or more occupants during sleep. In one or more embodiments, the foam within the innercore unit is made of any industry-standard natural and/or synthetic foams, such as (but not limited to) latex, polyurethane, or other foam products commonly known and used in the bedding and seating arts having a density of 1.5 to 1.9 lb/ft3 and 20 to 35 pounds-force ILD. Although a specific foam composition is described, those skilled in the art will realize that foam compositions other than one having this specific density and ILD can be used. For example, foams of various types, densities, and ILDs may be desirable in order to provide a range of comfort parameters to the buyer.

The foam innercore unit 204 may comprise one or more horizontal layers of multiple types of foams arranged in a sandwich arrangement. This sandwich of different foams, laminated together, may be substituted for a homogeneous foam block of a single density and/or ILD.

In a further embodiment, the foam innercore 204 may comprise one or more vertical regions of different foam compositions (including vertical regions having multiple horizontal layers), where the different foams are arranged to provide different amounts of support (also referred to as "firmness" in the art) in different regions of the sleeping surface.

Optionally, the mattress assembly can further include a foam side rail assembly about all or a portion of the perimeter of the mattress layers including the foam or coil spring innercore. In one or more embodiments, the side rail assembly can be formed on the bottom most layer so as to define a bucket assembly. The side rails that define the assembly may be attached or placed adjacent to at least a portion of the perimeter of the mattress layers and may include metal springs, spring coils, encased spring coils, foam, latex, gel, viscoelastic gel, or a combination, in one or more layers. Side rails may be placed on opposing sides of the stacked mattress layers, on all four sides of the stacked mattress layers, or only on one side of the stacked mattress layers. In certain embodiments, the side rails may comprise edge supports with firmness greater than that provided by the stacked mattress layers. The side rails may be fastened to the stacked mattress layers via adhesives, thermal bonding, or mechanical fasteners.

In one or more embodiments, the side rail assembly can be formed of open cell polyurethane foam having a non-random large cell structure or a random cellular structure with many large cells. The large cell structure can be defined by the number of cells per linear inch. In one embodiment, the large cell structure is about 10 to 40 cells per inch, with about 15 to 30 cells per inch in other embodiments, and with about 20 cells per inch in still other embodiments. The open cell foam structure includes a plurality of interconnected cells, wherein the windows between the adjacent cells are broken and/or removed. In contrast, in a closed cell foam there are substantially no interconnected cells and the windows between the adjacent cells are substantially intact. In reticulated foams, substantially all of the windows are removed. By using an open cell structure with a large open cellular structure, movement of moisture and air through a side rail can occur. Also, if the side rail is adhesively or thermally attached to the mattress layers, e.g., 102, 104, and 106, the skeletal struts of the open cell foam will bond to the mattress layers, thereby facilitating air and moisture transfer from the mattress layers through the side layers to the environment. In one or more embodiments, the side rail assembly includes a reticulated viscoelastic polyurethane foam.

For ease in manufacturing the mattress assembly, the side rail assembly may be assembled in linear sections that are joined to one another to form the perimeter about the mattress layers. The respective ends may be square or may be mitered.

Other layers may include any materials suitable for a mattress, such as batting, foam, waterproof liners, and so forth. In certain assemblies using coils, the one or more additional layers may include a relatively firm bottom panel layer that distributes the upward force of each spring top to provide a more uniform feel to the sleeping surface.

Figure 5:
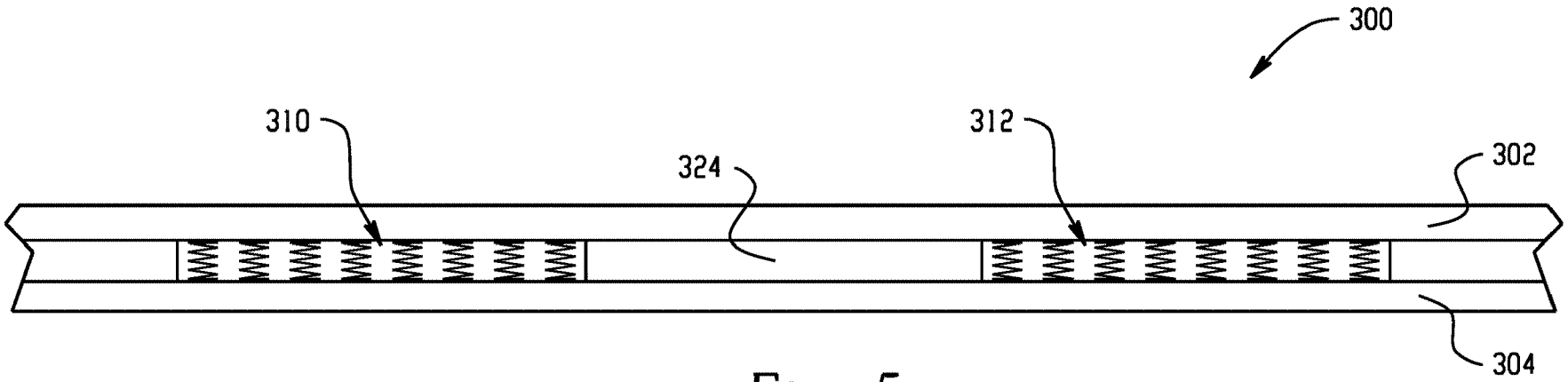
FIG. 5 illustrates a cross sectional view of a hybrid posture support system in accordance with one or more other embodiments of the present disclosure.

Referring now to FIG. 5, there is depicted a hybrid posture support system 300 that can be used in the above described coil spring inner core or foam innercore mattress assemblies in accordance with one or more embodiments of the present invention. The hybrid posture support system 300 includes a top foam layer 302 and an underlying foam layer 304. Intermediate the top and underlying foam layers 302, 304, respectively, are first and second microcoil array portions 310, 312 embedded therein or attached to a selected one or both of the top foam layer 302 and the underlying foam layer 304. The first and second microcoil array portions 320, 322, respectively, are spaced part and generally correspond to a head/shoulder region and a foot region of the mattress assembly. A foam portion 324 is intermediate and abuts the first and second microcoil array portions 310, 312. The foam portion 324 and the microcoil array portions 320, 322 are centrally located along a length of the mattress as previously described and generally corresponds to the lumbar region of a mattress. In contrast, the first and second microcoil array portions 310, 312 generally correspond to the head region and the foot leg regions.

Referring In one or more embodiments, the foam portion 324 can have a length from about 6 inches to about 60 inches. In one or more other embodiments, the foam portion 324 can have a length of about 12 to about 36, and in still one or more other embodiments, the foam portion 324 can have a length of about 18 to about 28 inches, which is positioned to generally correspond to the lumbar portion of a mattress.

The first and second foam portions 110, 112, can have the same lengths or different lengths. In one or more embodiments, the first and second microcoil array portions 310, 312 can have lengths of about 4 inches to about 24 inches. In one or more other embodiments, the first and second microcoil array portions 310, 312 can have lengths of about 6 inches to about 18 inches, and in still one or more embodiments, the first and second microcoil array portions 310, 312 can have lengths of about 8 inches to about 12 inches. As noted above, the first and second microcoil array portions 310, 312 generally correspond to the head/shoulder region and the foot/leg region and abut each end of the foam portion 324.

In still one or more other embodiments, the hybrid posture support system can include one or more air bladders in place of a selected one of the adjacent portions or the centrally located portion. For example, air bladders can be used in place of first and second foam portions 110, 112 or can be used in place of the pocketed microcoil array 114 in mattress assemblies 100, 200.

The mattress assemblies, and any variations thereof, may be manufactured using techniques known in the art of mattress making, with variations to achieve the mattress described above. Likewise, the various mattress layers in the mattress assemblies described above may be adjoined to one another using an adhesive or may be thermally bonded to one another or may be mechanically fastened to one using known in the art.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A hybrid posture support system for a mattress assembly comprising:

a top foam layer including top and bottom planar surfaces spanning an entire width and length of the mattress assembly, the top foam layer comprising a planar top surface and a cavity defined in a lower bottom surface;

a hybrid layer provided in the cavity of the top foam layer comprising first and second foam portions having a width that spans the entire width of the top foam layer and a length that is a fraction of a length of the top foam layer, wherein the first and second foam portions are spaced apart from one another and generally correspond to a head/shoulder region and a foot region, and a single pocketed microcoil array generally corresponding to a lumbar region underlying the top latex foam layer intermediate and abutting the spaced apart first and second foam portions, wherein the single pocketed microcoil array spans the entire width of the top foam layer and a length that is a fraction of the length of the top foam layer, wherein the hybrid layer has a bottom planar surface coplanar to bottommost surfaces of the top foam layer, and wherein the single pocketed microcoil array comprises a plurality of microcoils arranged in columns and rows encased in a fabric and have an unloaded height of less than 3 inches; and a foam layer underlying the hybrid layer comprising top and bottom planar surfaces.

2. The hybrid posture support system of claim 1, wherein the top foam layer and/or the underlying foam layer comprises polyurethane.

3. The hybrid posture support system of claim 1, wherein the length of the single pocketed microcoil array is within a range of about 6 inches to about 60 inches; and the length of the first and second foam portions is within a range of about 6 inches to about 18 inches.

4. The hybrid posture support system of claim 1, wherein the first and second foam portions have a density greater than the foam top layer.

5. The hybrid posture support system of claim 1, wherein the first and second foam portions have an indention load deflection value greater than the foam top layer.

6. A mattress assembly comprising:

a mattress innercore spanning a length and width dimension of the mattress assembly in its entirety comprising at least one coiled spring layer, and an underlying foam support layer, the at least one coiled spring layer has a height within a range of at least 4 inches to about 12 inches;

a hybrid posture support system spanning the width and the length of the mattress assembly, the hybrid posture support system comprising a top foam layer including top planar surface and a cavity in a bottom surface, a hybrid layer comprising first and second foam portions provided within the cavity of the top foam layer having a width that spans a width of the mattress assembly and a length that is a fraction of a length of the mattress assembly, wherein the first and second foam portions are spaced apart from one another and generally correspond to a head/shoulder region and a foot region, and wherein the first and second foam portions includes a bottom planar surface coplanar to a bottommost surface of the top foam layer; a single pocketed microcoil array generally corresponding to a lumbar region underlying the top foam layer intermediate the spaced apart first and second foam portions, wherein the single pocketed microcoil array spans the width and a fraction of the length of the mattress assembly, wherein the single pocketed microcoil array includes a substantially planar bottom surface coplanar to bottom planar surfaces of the first and second foam portions, and the bottommost surfaces of the top foam layer, and wherein the pocketed microcoil array comprises a plurality of microcoils arranged in columns and rows encased in a fabric and have an unloaded height of less than 3 inches; and foam layer underlying hybrid layer; and one or more overlying foam layers.

7. The mattress assembly of claim 6, further comprising a side rail assembly circumscribing a perimeter of the innercore.

8. The mattress assembly of claim 6, wherein the length of the single pocketed microcoil array is within a range of about 6 inches to about 60 inches; and the length of the first and second foam portions is within a range of about 6 inches to about 18 inches.

9. The mattress assembly of claim 6, wherein the first and second foam portions have a density greater than the top foam layer.

10. The mattress assembly of claim 6, wherein the first and second foam portions have an indention load deflection value greater than the top foam layer.

11. The mattress assembly of claim 6, wherein the first and second foam portions, the top foam layer and the underlying foam layer comprise a latex foam, a polyurethane foam, a gel foam, a pre-stressed foam, a viscoelastic polyurethane foam, or combinations thereof.

12. The mattress assembly of claim 6, wherein the first and second foam portions, the top foam layer and the underlying foam layer further comprise a phase change material.

13. The mattress assembly of claim 6, wherein the pocketed microcoil array is centrally located with respect to a length of the mattress assembly.

14. A mattress assembly comprising:

a mattress foam innercore spanning an entire width and length of the mattress assembly;

a hybrid posture support system located along a length of the mattress assembly, the hybrid posture support system comprising a top foam layer including a top planar surface and a cavity within a bottom surface, a hybrid layer comprising first and second foam portions within the cavity of the top foam layer having a width that spans the entire width of the mattress assembly and a length that is a fraction of the length of the mattress assembly, wherein the first and second foam portions are spaced apart from one another and generally correspond to a head/shoulder region and a foot region, and wherein the first and second foam portions includes a bottom planar surface coplanar to the bottommost surface of the top foam layer; a single pocketed microcoil array generally corresponding to a lumbar region underlying the top foam layer and intermediate the spaced apart first and second foam portions, wherein the single pocketed microcoil array spans the entire width of the mattress assembly and a fraction of the length of the mattress assembly, wherein the single pocketed microcoil array includes a substantially planar bottom surface coplanar to bottom planar surfaces of the first and second foam portions, and the bottommost surfaces of the top foam layer, and wherein the pocketed microcoil array comprises a plurality of microcoils arranged in columns and rows encased in a fabric and have an unloaded height of less than 3 inches; and an foam layer underlying the hybrid layer; and one or more overlying foam layers.

15. The mattress assembly of claim 14, wherein the length of the single pocketed microcoil array is within a range of about 6 inches to about 60 inches; and the length of the first and second foam portions is within a range of about 6 inches to about 18 inches.

16. The mattress assembly of claim 14, wherein the first and second foam portions have a density greater than the top foam layer.

17. The mattress assembly of claim 14, wherein the first and second foam portions have an indention load deflection value greater than the top foam layer.

18. The mattress assembly of claim 14, wherein the first and second foam portions, the top foam layer and the underlying foam layer comprise a latex foam, a polyurethane foam, a gel foam, a pre-stressed foam, a viscoelastic polyurethane foam, or combinations thereof.

19. The mattress assembly of claim 14, wherein the first and second foam portions, the top foam layer and the underlying foam layer further comprise a phase change material.

20. The mattress assembly of claim 14, further comprising a side rail assembly about at least the mattress innercore.

* * * * *